US005172837A

United States Patent [19]

Finney, Jr. et al.

[11] Patent Number: 5,172,837

[45] Date of Patent: Dec. 22, 1992

[54] DEVICE FOR WASHING A BALL CAP IN A DISH WASHER

[76] Inventors: Harold W. Finney, Jr., 31053 DeLa Vista Ave., San Juan Capistrano, Calif. 92675; John D. Forthey, 25111 Pizarro, El Toro, Calif. 92630

[21] Appl. No.: 720,244

[22] Filed: Jun. 24, 1991

[51] Int. Cl.[5] ..... A42C 1/00; A42C 5/00

[52] U.S. Cl. ..... 223/23; 223/24; 223/66; 223/84; 2/185 B; 2/185 C; 2/180; 2/209.5

[58] Field of Search ..... 223/24, 66, 57, 84, 223/23; 2/185 B, 185 C, 180, 209.5

[56] References Cited

U.S. PATENT DOCUMENTS

| | | | |
|---|---|---|---|
| 595,648 | 12/1897 | O'Thayne | 223/66 |
| 1,111,363 | 9/1914 | Chiniquy et al. | 223/24 X |
| 2,490,508 | 12/1949 | Delgatto | 223/84 X |
| 2,675,558 | 4/1954 | Richard | 2/180 |
| 2,812,887 | 11/1957 | Palinkas | 223/24 |
| 3,161,293 | 12/1964 | Sander | 223/24 X |
| 3,746,221 | 7/1973 | Grifoni | 223/66 |
| 4,760,610 | 8/1988 | Wu et al. | 2/180 X |

FOREIGN PATENT DOCUMENTS

| | | | |
|---|---|---|---|
| 47319 | 3/1933 | Denmark | 223/24 |
| 599771 | 3/1933 | Fed. Rep. of Germany | 223/68 |
| 563005 | 3/1957 | Italy | 223/66 |

*Primary Examiner*—Werner H. Schroeder
*Assistant Examiner*—Bibhu Mohanty
*Attorney, Agent, or Firm*—Charles C. Logan, II

[57] ABSTRACT

A device for washing a ball cap in a dishwasher formed from a male top frame assembly and a female bottom frame assembly that nest together in a stacked formation. The front ends of the respective frame assemblies are pivotally secured to each other and there is structure for latching their rear ends together. There is a sufficient spacing between the respective frame assemblies when they are assembled together so that a ball cap placed between them is not wedged therein but free to move about. The ball cap device has been designed to be placed in a conventional dishwashing machine for washing a ball cap.

3 Claims, 2 Drawing Sheets

DEVICE FOR WASHING A BALL CAP IN A DISH WASHER

BACKGROUND OF THE INVENTION

The invention relates to ball caps and more specifically to a novel device within which a ball cap is placed so that it can be washed. The device is then placed inside a conventional dishwasher and the machine is run through a washing cycle.

In today's society the wearing of the ball cap style of cap is very popular. The use of the term ball cap is meant to identify caps such as baseball caps. Some caps have emblems of baseball teams, logos of companies, tourist areas, etc. on the crown of the hat. Many people find that they have a favorite ball cap and after it gets dirty and stained there is not a convenient method of washing the ball caps. Trying to wash a cap in a clothes washer is not a successful method of cleaning them. Most people do not take their dirty ball cap to a commercial dry cleaning store to have them cleaned.

Most of the structures that have been invented in the past that relate to cleaning hats are utilized only after the hat has been cleaned. The Sawyer U.S. Pat. No. 1,128,530 is directed to an adjustable hat block to maintain the shape of the hat. The Wolkenhauer U.S. Pat. No. 2,038,698 is directed to a hat cleaning device that is again used after the hat has been cleaned and for the purpose of forming the hat to its proper shape.

Other devices have been invented for drying ball caps. The Smith U.S. Pat. No. 2,704,176 is directed to such a device. It has a frame work that is inserted into the interior of the crown portion of the ball cap to stretch it tight. The Payne et al U.S. Pat. No. 4,491,256 is directed to a ball cap drying insert for ball caps. The Grommes U.S. Pat. No. 4,708,271 is directed to a hat drying form. The Thomas et al U.S. Pat. No. 4,941,601 is directed to a cap dryer and shaper.

None of the prior art devices have been designed to be placed into a dishwashing machine for the purpose of washing a ball cap captured within the device.

It is an object of the invention to provide a novel device into which a ball cap may be placed and then put into the interior of a conventional dishwasher for the purpose of washing the same.

It is another object of the invention to provide a novel device that is economical to manufacture and market.

It is also an object of the invention to provide a novel device that is made of material that will not rust or corrode.

It is an additional object of the invention to provide a novel device that can be easily used by either a child or adult.

SUMMARY OF THE INVENTION

The novel device is formed from two main members. They are the male top frame assembly and the female bottom frame assembly. These members are pivotally secured to each other at their front end which allows access to their interior merely by releasing the latching structure formed at their rear ends. This allows a ball cap to be placed in the space between the two members. The spacing ($\frac{1}{4}''$–$\frac{3}{8}''$) between the two members is such that the ball cap is not wedged between them but is free to move about. An important factor in the washing process of the ball cap is to have the brim and crown of the ball cap move freely about so that all its surfaces are exposed to the washing process. When the ball cap is gripped firmly in place during the washing process a soil line is left where the device holds it. The two frame members are each integrally formed of molded plastic material that does not rust or corrode.

The device in its preferred form has a full crown on both the male top frame assembly and the female bottom assembly. The male top frame assembly and the female bottom frame assembly each have a front end and a rear end. Their brim portions extend forwardly only from the front end of their crown portions so that they resemble the configuration of a baseball cap. An alternative embodiment would only have a forward half crown portion on each of these members. A second alternative embodiment could be formed using only a top ball cap brim frame assembly and a bottom ball cap brim frame assembly that would be pivotally secured to each other at their front end.

DESCRIPTION OF THE PREFERRED EMBODIMENT

Figure 1:
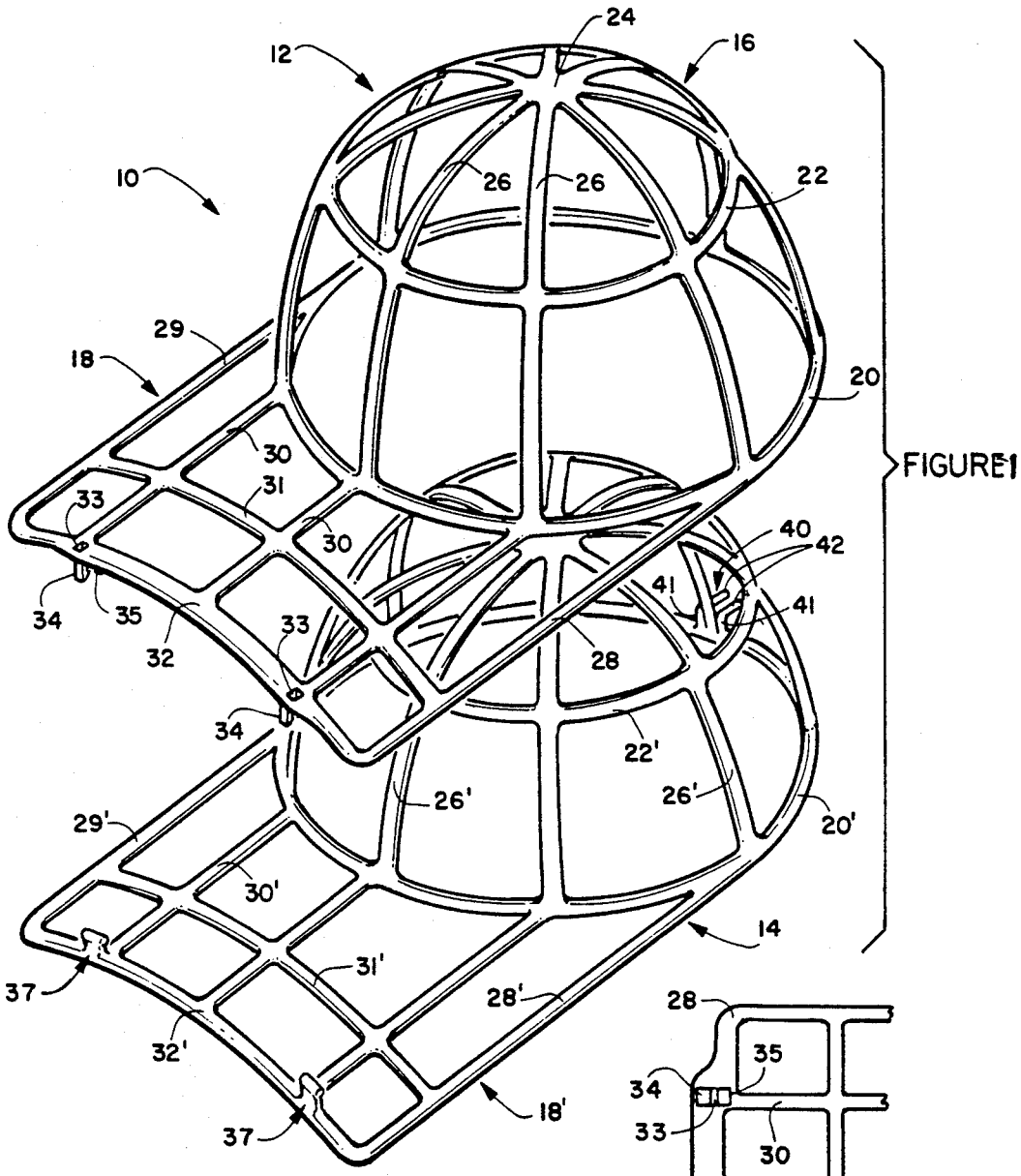
FIG. 1 is a front perspective view illustrating the novel device for washing a ball cap in a dishwasher.

The novel ball cap device will now be described by referring to FIGS. 1-5 of the drawings. The ball cap device is generally designated numeral 10. It has a male top frame assembly 12 and a female bottom frame assembly 14.

Male top frame assembly 12 has a crown portion 16 and a brim portion 18. Crown portion 16 has a circular crown base rib 20, a circular intermediate horizontal rib 22, an apex web joint 24 and a plurality of upright ribs 26. Brim portion 18 has a left side longitudinal rib 28, a right side longitudinal rib 29, a plurality of intermediate longitudinal ribs 30, and an intermediate transverse rib 31. A front cross member 32 has two sets of downwardly extending resilient fingers 34 and 35 that form front snap assemblies 36. Fingers 34 and 35 extend downwardly from the front and rear edges of apertures 33.

Figure 3:
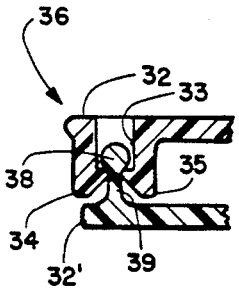
FIG. 3 is a cross sectional view taken along lines 3—3 of FIG. 2.
Figure 2:
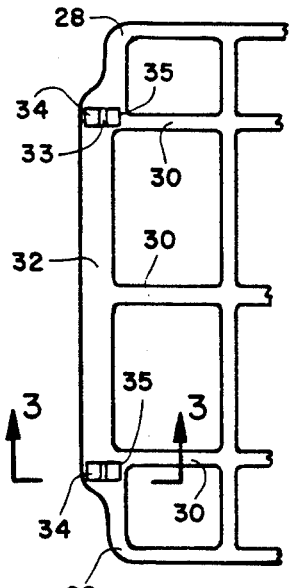
FIG. 2 is a partial bottom view of the front cross member of the male top frame assembly.

Female bottom frame assembly 14 is substantially identical to male top frame assembly 12 except that it does not have the same structure of front cross member 32 but instead has a front cross member 32' having laterally spaced upstanding protrusions 37 that snap into the recesses formed by resilient fingers 34 and 35 (see FIG. 3). Protrusions 37 have a head portion 38 and a neck portion 39. Also a rear catch assembly 40 illustrates the structure for capturing the respective circular crown base ribs 20 and 20' together. Rear snap assembly 40 has a pair of laterally spaced upstanding posts 41 each having rearwardly extending leg members 42 at their top ends. The female bottom frame assembly has prime (') notations with their numbers to identify them and their structure that is identical to that of the male top frame assembly.

Figure 4:
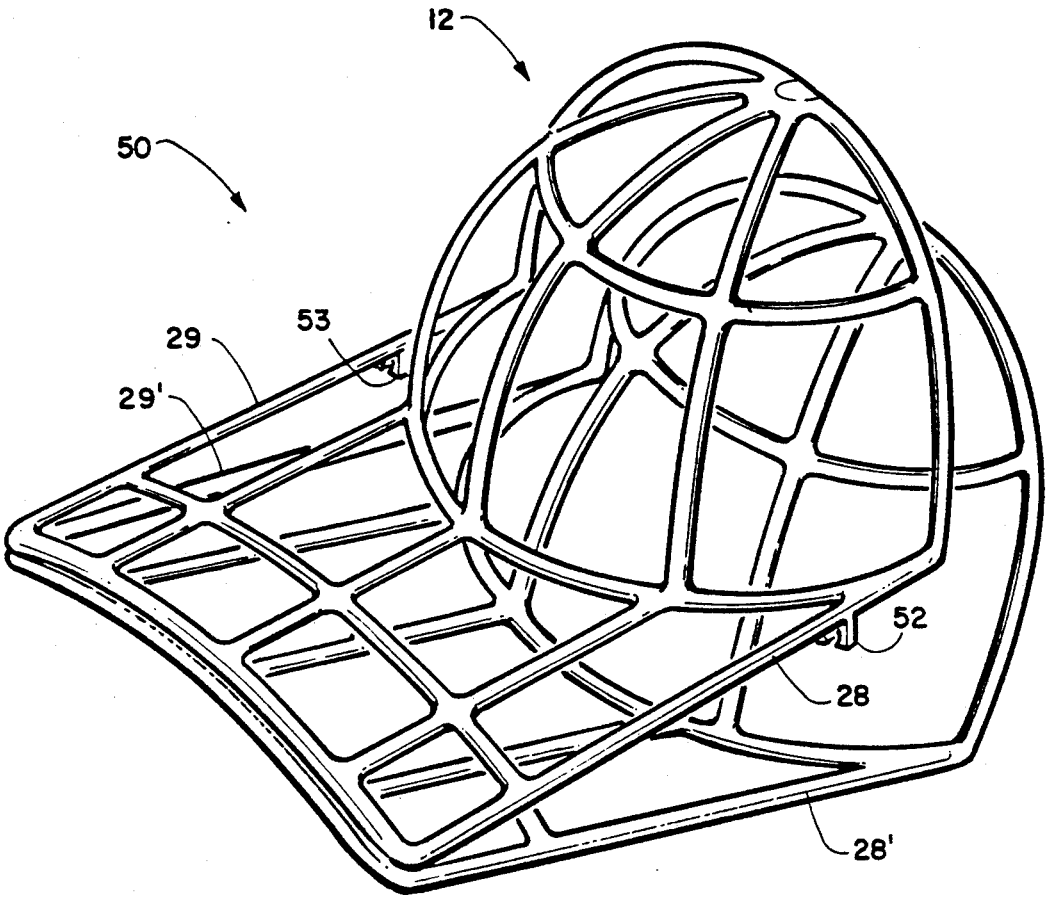
FIG. 4 is a first alternative embodiment of the device for washing a ball cap in a dishwasher.

A first alternative embodiment of the ball cap washing device is illustrated in FIG. 4 and it is generally designated numeral 50. Its structural members are substantially identical to the structure of ball cap device 10, but it only has a forward half crown for the respective male top frame assembly 12 and female bottom frame assembly 14. It has a pair of laterally spaced side snap assemblies 52 and 53 that engage the respective left and right side longitudinal ribs 28' and 29'.

Figure 5:
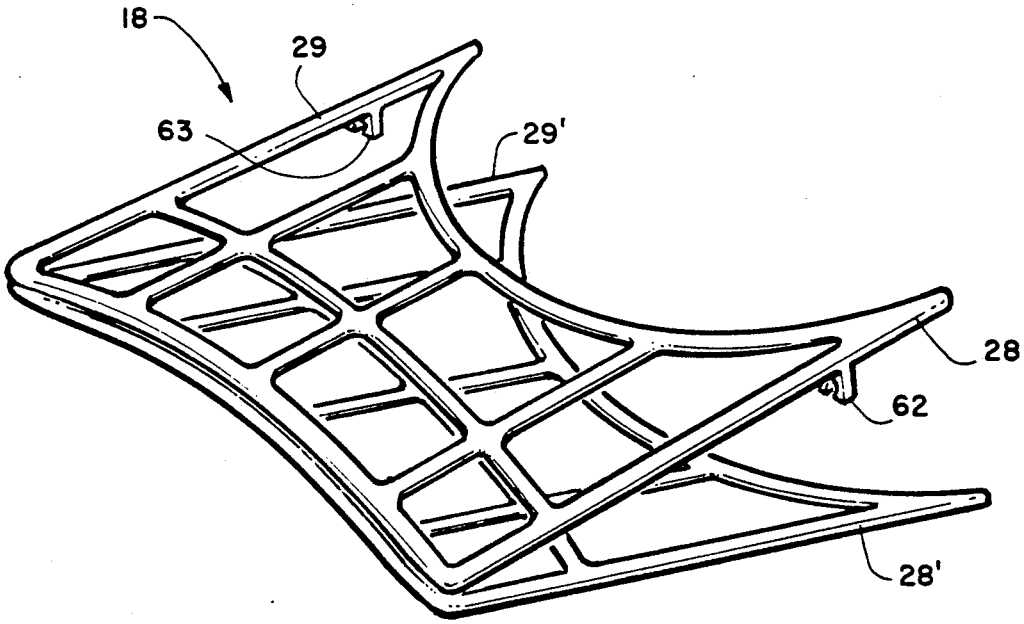
FIG. 5 is a second alternative embodiment of the device for washing a ball cap in a dishwasher.

A second alternative embodiment of the ball cap washing device is illustrated in FIG. 5 and it is designated numeral 18. It has only the brim portions 28 and 28' that are pivotally secured at their front ends. A pair of snap assemblies 62 and 63 are formed on the respective left side and right side longitudinal ribs 28 and 29.

What is claimed is:

1. A device for washing a ball cap in a dishwasher comprising:

a male top frame assembly having a top crown portion, said a top crown portion having a front end, a rear end, a left side and a right side, said top crown portion having a base and an apex;

a top brim portion extending forwardly only from the front end of said top crown portion, said top brim portion having a front end formed by a transversely extending front cross member that has a left end, a right end and a bottom surface;

a female bottom frame assembly having a bottom crown portion, said bottom frame portion having a front end, a rear end, a left side and a right side, said bottom crown portion having a base and an apex;

a bottom brim portion extending forwardly only from the front end of said crown portion, said bottom brim portion having a front end formed by a transversely extending front cross member that has a left end and a right end and a top surface;

the bottom surface of said male top frame assembly is spaced a predetermined distance D1 from the top surface of said female bottom frame assembly when they are secured to each other so that a ball cap placed between them is not wedged therein but is free to move about;

said male top frame assembly and female bottom frame assembly are each entirely integral members made of molded plastic material;

means for pivotally securing the front end of said top brim portion to the front end of said bottom brim portion at two laterally spaced points comprising: the front cross member of said top brim portion having an aperture therein adjacent its right end and its left end, a pair of resilient fingers extending downwardly from the front and rear edges of each of said apertures; the front cross member of said bottom brim portion having laterally spaced upstanding protrusions that detachably interlock with said resilient fingers; and means for detachably securing the rear end of said top crown portion to the rear end of said bottom crown portion.

2. A ball cap device as recited in claim 1 wherein the top crown portions of said male top frame assembly and said female bottom frame assembly are formed with only a front arc portion.

3. A ball cap device as recited in claim 1 wherein said male top frame assembly and said female bottom frame assembly are each formed with a lattice-type framework.

* * * * *